US010794633B2

(12) United States Patent
Andreae

(10) Patent No.: US 10,794,633 B2
(45) Date of Patent: Oct. 6, 2020

(54) OVEN WITH INTERNAL VOC CATALYST

(71) Applicant: SST Systems, Inc., Sturgeon Bay, WI (US)

(72) Inventor: Bradley M. Andreae, Sturgeon Bay, WI (US)

(73) Assignee: SST Systems, Inc., Sturgeon Bay, WI (US)

( * ) Notice: Subject to any disclaimer, the term of this patent is extended or adjusted under 35 U.S.C. 154(b) by 153 days.

(21) Appl. No.: 16/178,036

(22) Filed: Nov. 1, 2018

(65) Prior Publication Data

US 2019/0137180 A1 May 9, 2019

Related U.S. Application Data

(60) Provisional application No. 62/581,218, filed on Nov. 3, 2017.

(51) Int. Cl.

| | |
|---|---|
| ***F26B 3/00*** | (2006.01) |
| ***F26B 23/02*** | (2006.01) |
| ***F26B 21/04*** | (2006.01) |
| ***F26B 15/14*** | (2006.01) |
| ***F26B 1/00*** | (2006.01) |
| ***F26B 3/04*** | (2006.01) |
| ***F26B 15/12*** | (2006.01) |
| ***F26B 21/02*** | (2006.01) |

(52) U.S. Cl.

CPC ..... *F26B 23/024* (2013.01); *F26B 1/00* (2013.01); *F26B 3/04* (2013.01); *F26B 15/12* (2013.01); *F26B 15/14* (2013.01); *F26B 21/02* (2013.01); *F26B 21/04* (2013.01); *F26B 2210/12* (2013.01)

(58) Field of Classification Search

CPC ..... F26B 23/024; F26B 21/02; F26B 15/14; F26B 1/00; F26B 3/04; F26B 15/12; F26B 2210/12

USPC ..... 126/100; 34/434

See application file for complete search history.

(56) References Cited

U.S. PATENT DOCUMENTS

| | | | | |
|---|---|---|---|---|
| 4,384,850 | A * | 5/1983 | Dixon | B01D 53/86 432/72 |
| 7,370,647 | B2 * | 5/2008 | Thorneywork | H05B 6/6405 126/21 A |
| 2009/0050129 | A1 * | 2/2009 | Robinson, Jr. | F24C 15/2014 126/19 R |
| 2014/0342092 | A1 * | 11/2014 | Andreae | B65G 49/0459 427/430.1 |

* cited by examiner

*Primary Examiner* — John P McCormack

(74) *Attorney, Agent, or Firm* — Michael Best & Friedrich LLP

(57) ABSTRACT

An industrial oven includes an oven chamber configured to receive a plurality of workpieces for drying or curing. A heater box of the oven has a heating element therein operable to heat air for delivery to the oven chamber. A circulation system of the oven is operable to force hot air from the heater box into the oven chamber. A VOC oxidation catalyst is provided in the circulation system.

19 Claims, 3 Drawing Sheets

OVEN WITH INTERNAL VOC CATALYST

CROSS-REFERENCE TO RELATED APPLICATIONS

This application claims priority to U.S. Provisional Patent Application No. 62/581,218, filed Nov. 3, 2017, the entire contents of which are incorporated by reference herein.

BACKGROUND

The present invention relates to finishing systems and processes for manufactured parts, and may also relate to carriers for transporting manufactured parts through a finishing process, and methods relating to the same. For example, a finishing process can include a painting or an electroplating process whereby manufactured parts are immersed in a dip tank full of fluids. The coatings applied to manufactured parts may be dried or cured in an industrial oven, the process of which can release volatile organic compounds (VOCs). Although VOC emission can be controlled to a satisfactory degree by the use of VOC catalysts, they often require heating and introduce an additional energy consumer in the overall system or process.

SUMMARY

In one aspect, the invention provides an industrial oven including an oven chamber through which a conveyor (e.g., an overhead conveyor) extends. A heater box is coupled to the oven chamber, and includes at least one heating element. A circulation system forces hot air from the heater box into the oven chamber. The circulation system recirculates at least a portion of the air from the oven chamber back to the heater box. A VOC oxidation catalyst is provided in the circulation system, either within the heater box or within the oven chamber.

In another aspect, the invention provides a method of operating an industrial oven with VOC emissions control. An oven chamber is heated by operation of a heating element within a heater box coupled to the oven chamber. One or more coated workpieces are conveyed through the oven chamber and are heated, releasing airborne VOCs. Air, including the airborne VOCs is circulated from the oven chamber back to the heater box through a circulation system. The air in the circulation system is passed through a VOC catalyst, such as a VOC oxidation catalyst, and heat is released from the VOC catalyst reaction into the air to reduce the heating load on the heating element.

Other aspects of the invention will become apparent by consideration of the detailed description and accompanying drawings.

DETAILED DESCRIPTION

Figure 1:
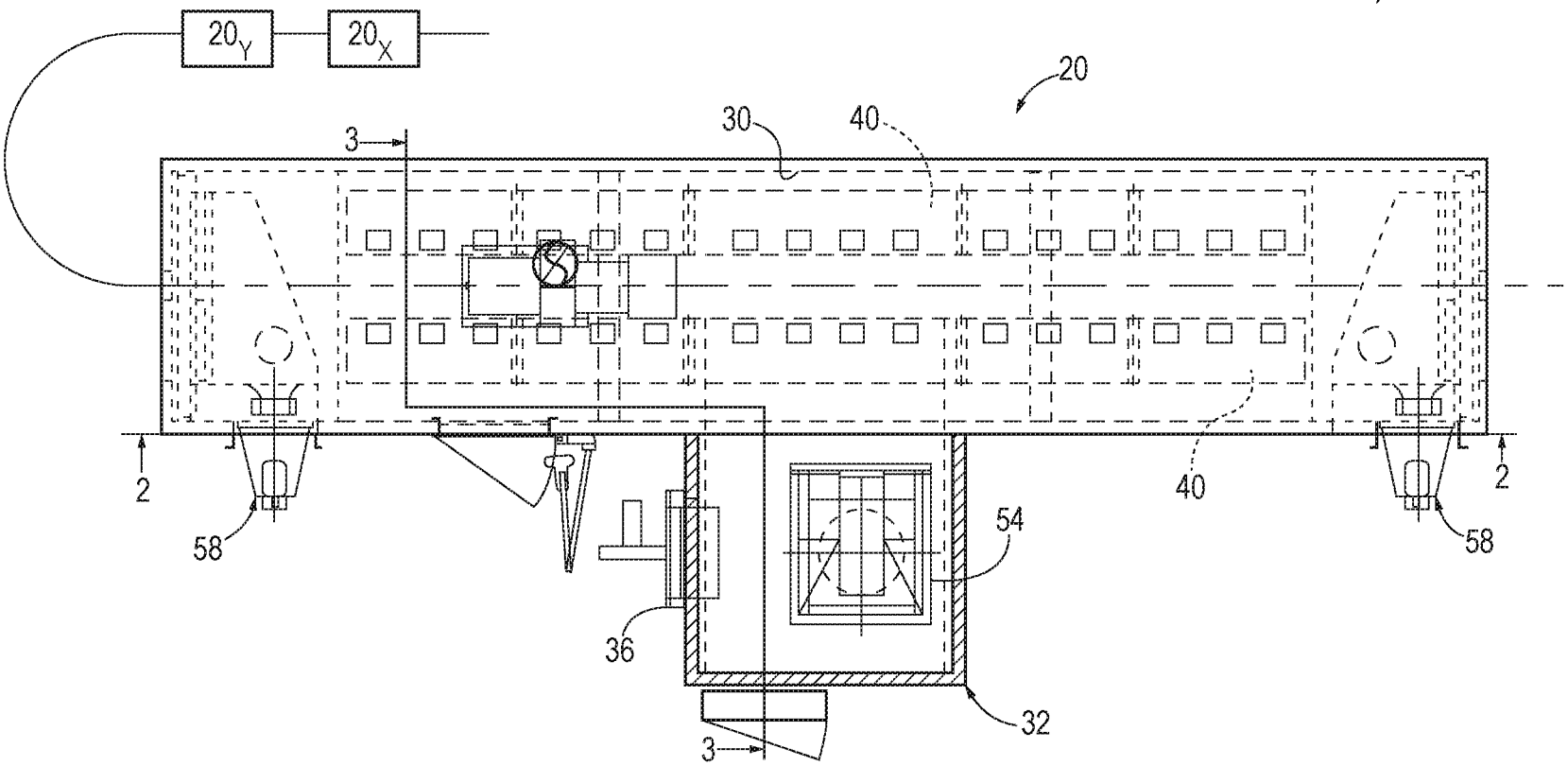
FIG. 1 is a plan view of an industrial oven according to one embodiment of the invention.
Figure 2:
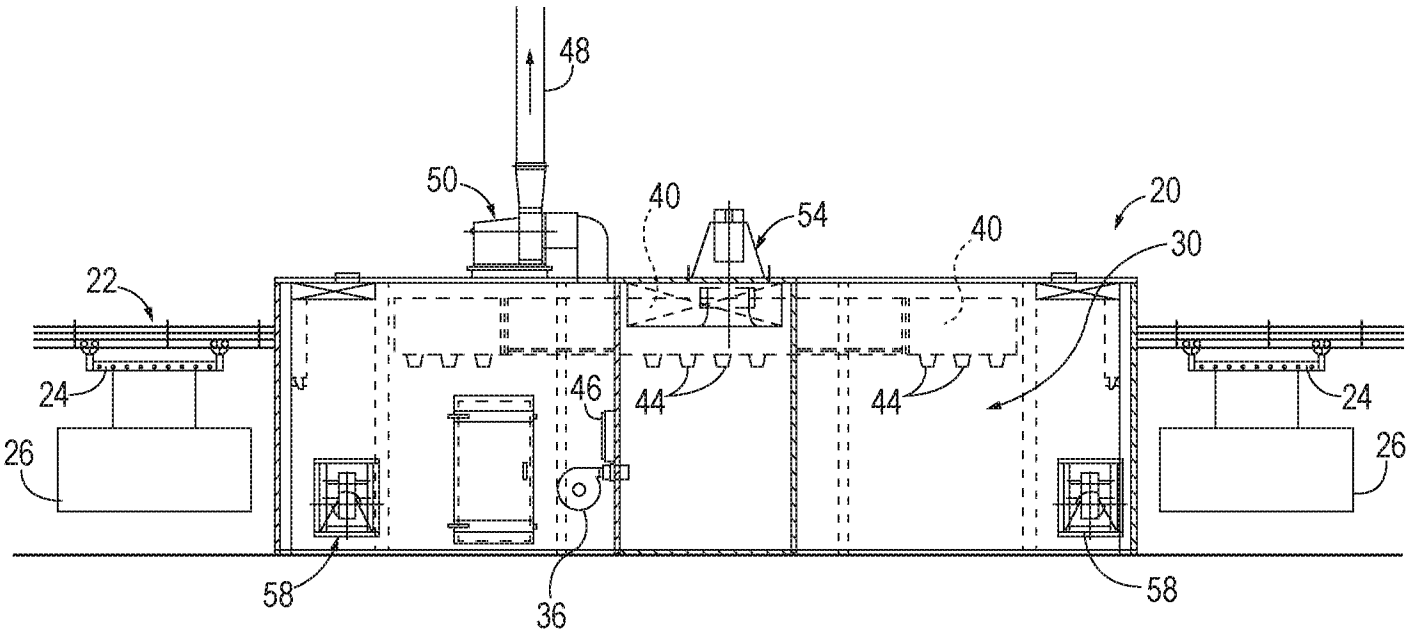
FIG. 2 is a cross-section of the industrial oven shown in FIG. 1, taken along line 2-2 of FIG. 1.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

As part of a finishing system 10 for applying finishes to manufactured components, an industrial oven 20 is provided downstream of one or more other workstations. A conveyor 22 (e.g., an overhead conveyor supporting carrier assemblies 24) is provided and operated to transport workpieces 26 through the finishing system, including through the oven 20. Each workstation of the finishing system is designed to perform a different manufacturing process, such as dipping, painting, drying, assembling, or otherwise modifying a workpiece or assembly of workpieces. The oven 20 for example provides a drying or curing workstation for drying or curing a coating applied to the workpieces 26 at one or more upstream workstations. For example, the workpieces 26 can be cleaned at a first workstation $\mathbf{20}_X$ upstream of the oven 20, and the cleaned workpieces 26 can receive a surface finish application at a second workstation $\mathbf{20}_Y$ downstream of the first workstation $\mathbf{20}_X$ and upstream of the oven 20.

The workpieces 26 can be consumer goods of metal, plastic, or wood onto which a coating of some type is applied as part of the finishing system prior to sale of goods to an intermediate or end user. The coating(s) may require a drying or curing process in order to properly ready the goods for final assembly, packaging, or sale. The coatings can be thermally cured coatings, which are heated in a cure oven, such as the oven 20, defining an oven chamber 30. The oven chamber 30 can be heated with steam, electrically generated heat, or a combustion-generated heat, although any number of alternate heat sources can also be utilized, including for example solar or geothermal energy. In the illustrated construction, the oven 20 includes a heater box 32 adjacent and adjoining the oven chamber 30. The heater box 32 includes a heating element 36, in some constructions a fuel-fired burner. Heated air from the heater box 32 is delivered to the oven chamber 30 through a duct assembly including one or more ducts 40 that extend to the oven chamber 30. Additionally, the heated air may be delivered from the ducts 40 to the oven chamber 30 through nozzles 44 to achieve desired air delivery velocities and locations in the oven chamber 30.

Although the illustrated heater box 32 includes a make-up air inlet 46 for intake of fresh air, and an exhaust system (e.g., exhaust fan 50 provided to exhaust air through an exhaust stack 48), heated air is circulated between the oven chamber 30 and the heater box 32 through a circulation system. The ducts 40 form part of the circulation system, along with a circulation fan 54 and a heated air return 56 (see FIG. 3) from the oven chamber 30 to the heater box 32. The heated air return 56 can optionally include one or more filters. Although one or more movable doors may be provided at the upstream and downstream ends of the oven 20 in some constructions, alternatively or additionally, an air seal is provided at each of the upstream and downstream ends of the oven 20. The air seal helps to contain heated air within the oven chamber 30, and inhibit the ingress of ambient air, for greater efficiency. The air seals can be provided by respective air seal fans 58. Additionally, it is noted that the walls defining the oven 20, including the oven chamber 30 and the heater box 32 can be constructed as thermally insulating walls, e.g., having multiple spaced material sheets separated by a layer of insulation.

Thermally cured parts may release chemical components into the atmosphere within the oven 20. These compounds often include volatile organic compounds (VOCs). VOC emissions from industrial facilities are regulated by federal, state, and local laws. The laws may require various types of abatement of VOCs. One such type of abatement is thermal oxidation, in which the VOC's are converted to $CO_2$ through high temp incineration. Catalytic oxidation makes use of catalyst beds to allow the same conversion with significantly less fuel than thermal oxidizers, which reduces continuous operational cost. Other types of catalyst-based VOC abatement are possible, and fall within the spirit and scope of the present invention.

Figure 3:
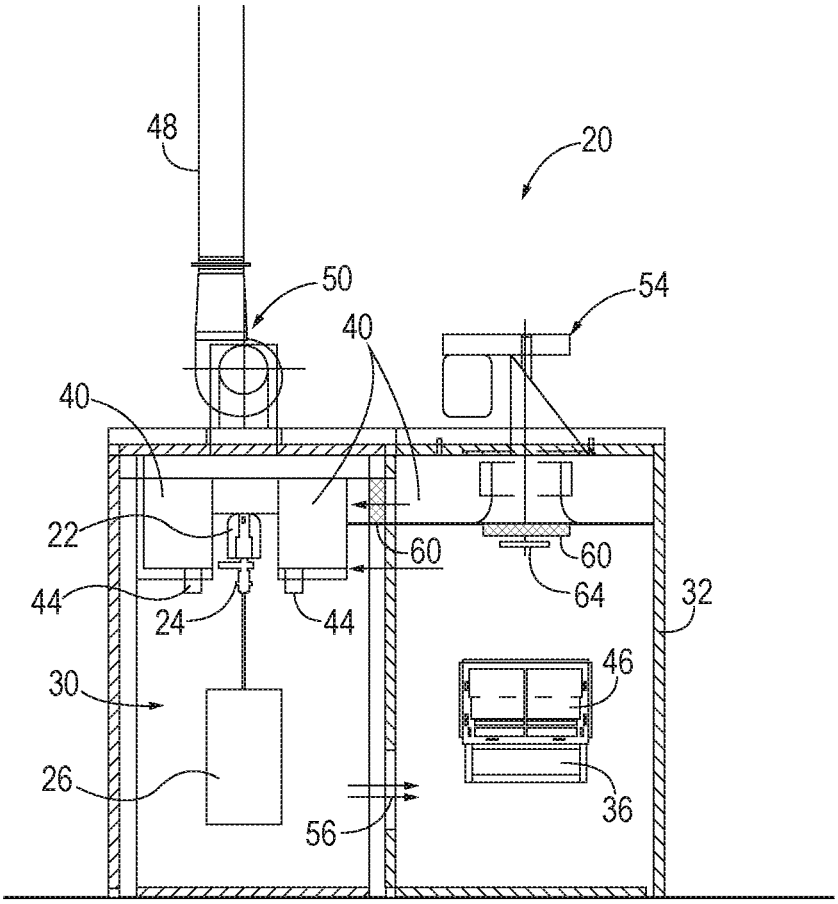
FIG. 3 is a cross-section of the industrial oven shown in FIGS. 1 and 2, taken along line 3-3 of FIG. 1.

The illustrated oven 20 includes a VOC oxidation catalyst, referred to herein as a catalytic oxidizer 60 within the circulation system of the oven 20. Particularly, the catalytic oxidizer 60 is not positioned to receive air moving to and through the exhaust stack 48, but rather is positioned inside the heater box 32 or inside the oven chamber 30. FIG. 3 illustrates two exemplary positions for the catalytic oxidizer 60, either or both of which may be utilized in a particular oven construction. Each catalytic oxidizer 60 can include a catalytic bed of any one or more of mesh, rods, packed spheres, porous sintered material, or other catalyst media. In some embodiments, the catalytic oxidizer 60 can be activated with base metal oxides (Cu—, Co—, Cr—, Mo—, Fe—, etc.) or a platinum group metal such as platinum or palladium.

By utilizing the illustrated catalytic oxidizer 60 within the circulation system, several benefits can be achieved. For one, VOC regulatory limits can be reached without additional equipment. In some constructions, the exhaust system is provided without any catalytic oxidizer or, more particularly, without any VOC abatement device. Furthermore, heat from the oxidation process (exothermic) is released into the oven chamber 30 to be used in the curing process, thus reducing the energy (e.g., fuel) requirement of the heating element 36 for heating the oven 20. This is true, whether the catalytic oxidizer 60 is located directly within the oven chamber 30 or within the heater box 32 that supplies heat to the oven chamber 30. During start-up operations, prior to running the workpieces 26 through the oven chamber 30, preparation of the oven 20 can include preheating of the oven chamber 30 and the catalytic oxidizer 60. In fact, the catalytic oxidizer 60 may be preheated along with the oven chamber 30 by the heating element 36 of the heater box 32. Depending on the set point of the oven chamber 30, no further heating element may be required for the catalytic oxidizer 60 to reach its light-off temperature. In some constructions, the method of operation includes preheating the catalytic oxidizer 60 to its light-off temperature during oven chamber preheating with nothing more than the heat supplied for oven chamber preheating. Preheating of the catalytic oxidizer 60 to the light-off temperature may be achieved with the exhaust stack 48 closed in some constructions, or at least with the exhaust fan 50 turned off. Namely, the catalytic oxidizer 60 is preheated to the light-off temperature by directly absorbing heat from the heater box 32 and/or directly absorbing heat from the duct(s) 40 supplying the oven chamber 30 from the heater box 32. As an option, a dedicated catalyst heater 64 can be provided. Even when a dedicated catalyst heater 64 is used, any heat not directly absorbed by the catalytic oxidizer 60 is useful in reducing the heating demand from the heating element 36 of the heater box 32 for heating the oven chamber 30. As an added benefit, the interior wall surfaces of the oven chamber 30 stay cleaner longer since the catalytic oxidizer 60 scrubs the circulating air of VOCs, slowing the build-up of residue on the walls that occurs due to contact with airborne organic materials in various forms (e.g., gaseous, liquid droplet, and/or solid particulate).

What is claimed is:

1. An industrial oven comprising:

an oven chamber configured to receive a plurality of workpieces for drying or curing;

a heater box having a heating element therein operable to heat air for delivery to the oven chamber;

a circulation system operable to force hot air from the heater box into the oven chamber; and a VOC oxidation catalyst provided in the circulation system, wherein the VOC oxidation catalyst is positioned at least partially within the oven chamber.

2. The industrial oven of claim 1, further comprising a conveyor extending through the oven chamber between an inlet and an outlet thereof.

3. The industrial oven of claim 1, wherein a further VOC oxidation catalyst is positioned at least partially within the heater box.

4. The industrial oven of claim 1, wherein the circulation system includes at least one duct operable to recirculate at least a portion of the air from the oven chamber back through the heater box, the at least one duct extending along an interior of the oven chamber and containing the VOC oxidation catalyst therein.

5. An industrial finishing system including the industrial oven of claim 1, wherein the industrial finishing system includes, upstream of the industrial oven, both a workpiece cleaning workstation and a surface finish application workstation.

6. The industrial finishing system of claim 5, further comprising a conveyor connecting the workpiece cleaning workstation, the surface finish application workstation, and the industrial oven and operable to transport workpieces therebetween.

7. The industrial oven of claim 1, further comprising an exhaust system including an exhaust fan and an exhaust stack operable to exhaust a portion of the oven chamber contents to ambient during operation, wherein the exhaust system is provided without any VOC abatement device.

8. A method of finishing manufactured workpieces, the method comprising:

transporting workpieces into an oven chamber of an industrial oven;

heating air in a heater box of the industrial oven with a heating element;

supplying the heated air through a circulation system to the oven chamber;

recirculating at least a portion of the heated air from the oven chamber back to the heater box; and operating a VOC catalytic oxidizer at a portion of the circulation system that is within the oven chamber to scrub VOCs from the heated air, the VOC catalytic oxidizer giving off reaction heat to serve as a heat source from within the oven chamber.

9. The method of claim 8, wherein the workpieces are transported on a conveyor.

10. The method of claim 9, further comprising cleaning the workpieces at a first workstation and applying a surface finish to the workpieces at a second workstation, wherein the workpieces are transported from the first workstation to the second workstation on the conveyor.

11. The method of claim 8, further comprising preheating the VOC catalytic oxidizer by direct heating from the oven chamber.

12. The method of claim 8, further comprising operating a further VOC catalytic oxidizer at a portion of the circulation system that is within the heater box.

13. The method of claim 8, further comprising exhausting a portion of the heated air from the oven chamber through an exhaust system, without performing any VOC abatement in the exhaust system.

14. An industrial oven comprising:

an oven chamber configured to receive a plurality of workpieces for drying or curing;

a heater box having a heating element therein operable to heat air for delivery to the oven chamber;

a circulation system operable to force hot air from the heater box into the oven chamber;

a first VOC oxidation catalyst provided at a position along the circulation system at least partially within the oven chamber; and a second VOC oxidation catalyst provided at a second position along the circulation system at least partially within the heater box.

15. The industrial oven of claim 14, wherein the circulation system includes at least one duct operable to recirculate at least a portion of the air from the oven chamber back through the heater box, the at least one duct extending along an interior of the oven chamber and containing the first VOC oxidation catalyst therein.

16. The industrial oven of claim 14, further comprising a conveyor extending through the oven chamber between an inlet and an outlet thereof.

17. The industrial oven of claim 14, further comprising an exhaust system including an exhaust fan and an exhaust stack operable to exhaust a portion of the oven chamber contents to ambient during operation, wherein the exhaust system is provided without any VOC abatement device.

18. The industrial oven of claim 14, wherein the industrial finishing system includes, upstream of the industrial oven, both a workpiece cleaning workstation and a surface finish application workstation.

19. The industrial oven of claim 18, further comprising a conveyor connecting the workpiece cleaning workstation, the surface finish application workstation, and the industrial oven and operable to transport workpieces therebetween.

* * * * *